US012063958B2

(12) United States Patent
Park et al.

(10) Patent No.: US 12,063,958 B2
(45) Date of Patent: Aug. 20, 2024

(54) DISPOSABLE LIQUID AEROSOL GENERATING ARTICLE AND AEROSOL GENERATING DEVICE

(71) Applicant: KT&G CORPORATION, Daejeon (KR)

(72) Inventors: In Su Park, Seoul (KR); Dong Kyun Ko, Sejong (KR); Sang Won Choi, Daejeon (KR); Sun Hwan Jung, Daejeon (KR); Eun Mi Jeoung, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 822 days.

(21) Appl. No.: 17/255,503

(22) PCT Filed: Oct. 29, 2019

(86) PCT No.: PCT/KR2019/014394

§ 371 (c)(1),
(2) Date: Dec. 23, 2020

(87) PCT Pub. No.: WO2020/091393

PCT Pub. Date: May 7, 2020

(65) Prior Publication Data

US 2021/0267271 A1 Sep. 2, 2021

(30) Foreign Application Priority Data

Oct. 30, 2018 (KR) ..... 10-2018-0131318

(51) Int. Cl.

| | |
|---|---|
| ***A24D 3/17*** | (2020.01) |
| ***A24F 40/10*** | (2020.01) |
| ***A24F 40/40*** | (2020.01) |

(52) U.S. Cl.
CPC ..... *A24D 3/17* (2020.01); *A24F 40/10* (2020.01); *A24F 40/40* (2020.01)

(58) Field of Classification Search
None
See application file for complete search history.

(56) References Cited

U.S. PATENT DOCUMENTS

| | | |
|---|---|---|
| 5,746,227 A | 5/1998 | Rose et al. |
| 7,726,320 B2 | 6/2010 | Robinson et al. |

(Continued)

FOREIGN PATENT DOCUMENTS

| | | |
|---|---|---|
| CA | 915543 A | 11/1972 |
| CN | 1503637 A | 6/2004 |

(Continued)

OTHER PUBLICATIONS

Office Action issued Jan. 11, 2022 in Japanese Application No. 2020-572688.

(Continued)

*Primary Examiner* — Tho D Ta
(74) *Attorney, Agent, or Firm* — Sughrue Mion, PLLC

(57) ABSTRACT

The present disclosure provides a disposable liquid aerosol generating article which includes an aerosol generating substrate portion and a filter portion, the aerosol generating substrate portion including an absorber impregnated with a liquid substance for forming an aerosol, and an amount of the liquid substance corresponding to 10 to 30 times of inhalation.

10 Claims, 7 Drawing Sheets

(56) References Cited

U.S. PATENT DOCUMENTS

| | | | | |
|---|---|---|---|---|
| 8,899,238 | B2 | 12/2014 | Robinson et al. | |
| 9,078,473 | B2 | 7/2015 | Worm et al. | |
| 10,334,883 | B2 | 7/2019 | Silvestrini et al. | |
| 10,780,236 | B2 | 9/2020 | Tucker et al. | |
| 2002/0166563 | A1 | 11/2002 | Jupe et al. | |
| 2008/0092912 | A1 | 4/2008 | Robinson et al. | |
| 2011/0041861 | A1 | 2/2011 | Sebastian et al. | |
| 2011/0132382 | A1 | 6/2011 | Kim et al. | |
| 2013/0192615 | A1 | 8/2013 | Tucker et al. | |
| 2014/0261486 | A1 | 9/2014 | Potter et al. | |
| 2014/0305455 | A1* | 10/2014 | Crooks | A24D 3/061 131/332 |
| 2015/0020823 | A1 | 1/2015 | Lipowicz et al. | |
| 2015/0209530 | A1 | 7/2015 | White | |
| 2016/0302471 | A1 | 10/2016 | Bowen et al. | |
| 2017/0027234 | A1 | 2/2017 | Farine et al. | |
| 2020/0000152 | A1 | 1/2020 | Mironov | |
| 2021/0106051 | A1 | 4/2021 | Han et al. | |

FOREIGN PATENT DOCUMENTS

| | | | | | |
|---|---|---|---|---|---|
| CN | 101557728 | A | | 10/2009 | |
| CN | 102131408 | A | | 7/2011 | |
| CN | 104394719 | A | * | 3/2015 | A24D 3/0229 |
| CN | 105530825 | A | | 4/2016 | |
| EA | 201690668 | A1 | | 9/2016 | |
| EP | 2 327 318 | A1 | | 6/2011 | |
| EP | 3 039 972 | A1 | | 7/2016 | |
| JP | 2010-506594 | A | | 3/2010 | |
| JP | 5978303 | B2 | | 8/2016 | |
| KR | 10-2013-0123236 | A | | 11/2013 | |
| KR | 10-2015-0035488 | A | | 4/2015 | |
| KR | 10-1554435 | B1 | | 9/2015 | |
| KR | 10-2016-0147256 | A | | 12/2016 | |
| KR | 10-2017-0007262 | A | | 1/2017 | |
| KR | 10-2017-0086127 | A | | 7/2017 | |
| KR | 20070100421 | A | * | 10/2017 | |
| KR | 10-2018-0111460 | A | | 10/2018 | |
| WO | WO-2012156703 | A1 | * | 11/2012 | A24D 1/002 |
| WO | 2015/074187 | A1 | | 5/2015 | |
| WO | 2015/082652 | A1 | | 6/2015 | |
| WO | 2015/101760 | A1 | | 7/2015 | |
| WO | 2016/188649 | A1 | | 12/2016 | |
| WO | 2017/042298 | A1 | | 3/2017 | |
| WO | 2018/182322 | A1 | | 10/2018 | |

OTHER PUBLICATIONS

Chinese Office Action dated Apr. 14, 2023 in Chinese Application No. 201980039482.2.

Notification of Reason for Refusal dated Sep. 27, 2021 in Korean Application No. 10-2018-0131318.

Extended European Search Report dated Sep. 16, 2021 in European Application No. 19879304.4.

Communication dated Oct. 8, 2021 from the Russian Patent Office in Russian Application No. 2021109420.

Communication dated Mar. 17, 2021 from the Korean Intellectual Property Office in application No. 10-2018-0131318.

International Search Report for PCT/KR2019/014394 dated Feb. 6, 2020 [PCT/ISA/210].

Extended European Search Report dated Jun. 27, 2024, issued in European Application No. 23217668.5.

* cited by examiner

DISPOSABLE LIQUID AEROSOL GENERATING ARTICLE AND AEROSOL GENERATING DEVICE

CROSS REFERENCE TO RELATED APPLICATIONS

This application is a National Stage of International Application No. PCT/KR2019/014394 filed Oct. 29, 2019, claiming priority based on Korean Patent Application No. 10-2018-0131318 filed Oct. 30, 2018, the disclosure of which is incorporated herein in its entirety by reference.

TECHNICAL FIELD

The present disclosure relates to a disposable liquid aerosol generating article, which may be used as a substitute for a cigarette, and an aerosol generating device.

BACKGROUND ART

Common types of aerosol generating device may include an electrically operated smoking device. A known electrically operated smoking device typically includes an aerosol generator 1 including a battery and an aerosol generating article 3 specifically designed to be used with the aerosol generator as illustrated in FIG. 1, and the aerosol generator 1 includes an electric heater for heating the aerosol generating article 3.

As an example of the electrically operated smoking device, the aerosol generating article 3 includes aerosol forming substrate plug such as a cigarette plug, and when the aerosol generating article 3 is inserted into the aerosol generator 1, a heater accommodated in the aerosol generator 1 heats the aerosol forming substrate plug to generate an aerosol.

The aerosol forming substrate plug included in the aerosol generating article 3 described above is used by filling at one time a liquid substance for forming an aerosol capable of being inhaled 200 to 500 times on average, thus being used for a long period of time with one filling.

However, if the aerosol generating device of the related art described above is used for a long period of time, a liquid substance for forming an aerosol may leak. Also, a hygiene problem such as bacterial contamination may occur because a mouthpiece filter is continuously used without being replaced, and liquid exposed to the air during use may change or flavor thereof may change.

Therefore, there is a need to develop a technology capable of solving the above-described problems.

PRIOR ART REFERENCES

Patent Reference (Patent reference 1) Korean Patent Application Publication No. 10-2013-0123236

DESCRIPTION OF EMBODIMENTS

Technical Problem

The present disclosure is devised to solve the problems of the related art described above, and an object of the present disclosure is to provide a disposable liquid aerosol generating article that may effectively solve problems such as leakage of a liquid substance for forming an aerosol, contamination of a mouthpiece filter, deterioration of a liquid substance for forming an aerosol, and deterioration of flavor, by restricting a liquid substance for forming an aerosol to less than an amount corresponding to 30 times of inhalation such that a disposable liquid aerosol generating article may be discarded after a single use.

Another object of the present disclosure is to provide a disposable liquid aerosol generating article that may be economically manufactured by wrapping an absorber impregnated with a liquid substance for forming an aerosol with general roll paper without the roll paper being wetted.

Another object of the present disclosure is to provide an aerosol generating device including the above-described disposable liquid aerosol generating article.

Technical Solution to Problem

In order to achieve the objects, the present disclosure includes an aerosol generating substrate portion and a filter portion, wherein the aerosol generating substrate portion includes an absorber impregnated with a liquid substance for forming an aerosol, and an amount of the liquid substance corresponds to 10 to 30 times of inhalation.

In one embodiment of the present disclosure, the liquid substance for forming an aerosol may be impregnated in the ratio of 0.05 g to 0.8 g of the liquid substance per 1 g of the absorber.

In one embodiment of the present disclosure, a proportion of the liquid substance transferred from the absorber to other constituent parts of the disposable liquid aerosol generating article at a point in time when 24 hours elapse after the disposable liquid aerosol generating article is completely manufactured may be 0 to 1% by weight.

In one embodiment of the present disclosure, the absorber impregnated with the liquid substance for forming an aerosol may be rolled and directly wrapped by roll paper of the disposable liquid aerosol generating article.

In one embodiment of the present disclosure, the roll paper may be non-waterproofed roll paper.

In one embodiment of the present disclosure, the absorber may be selected from the group consisting of paper, cotton, and silica.

In one embodiment of the present disclosure, the absorber may be formed by rolling wrinkled paper.

In one embodiment of the present disclosure, the absorber may be formed by rolling base paper in which stripe-shaped wrinkles or sheaths are formed by crimping.

In one embodiment of the present disclosure, the liquid substance may include nicotine in the amount of 0.1 to 5 parts by weight, glycerin in the amount of 5 to 60 parts by weight, and a solvent in the amount of 5 to 35 parts by weight.

In one embodiment of the present disclosure, the disposable liquid aerosol generating article may include a first filter portion and a second filter portion respectively provided at both ends of the aerosol generating substrate portion.

In addition, the present disclosure provides the disposable liquid aerosol generating article; and an aerosol generator including an aerosol generating article accommodation groove and a heater member provided on the bottom of the aerosol generating article accommodation groove.

Advantageous Effects of Disclosure

A disposable liquid aerosol generating article of the present disclosure may include a liquid substance for forming an aerosol such that the disposable liquid aerosol generating article may provide less than 30 times of inhalation and may be discarded after one-time use, and thus, problems such as leakage of a liquid substance for forming an aerosol, contamination of a mouthpiece filter, deterioration of a liquid substance for forming an aerosol, and deterioration of flavor may be effectively solved.

In addition, a disposable liquid aerosol generating article may be economically manufactured because roll paper is not wetted even though an absorber impregnated with a liquid substance for forming an aerosol is wrapped by general roll paper.

BEST MODE

Figure 1:
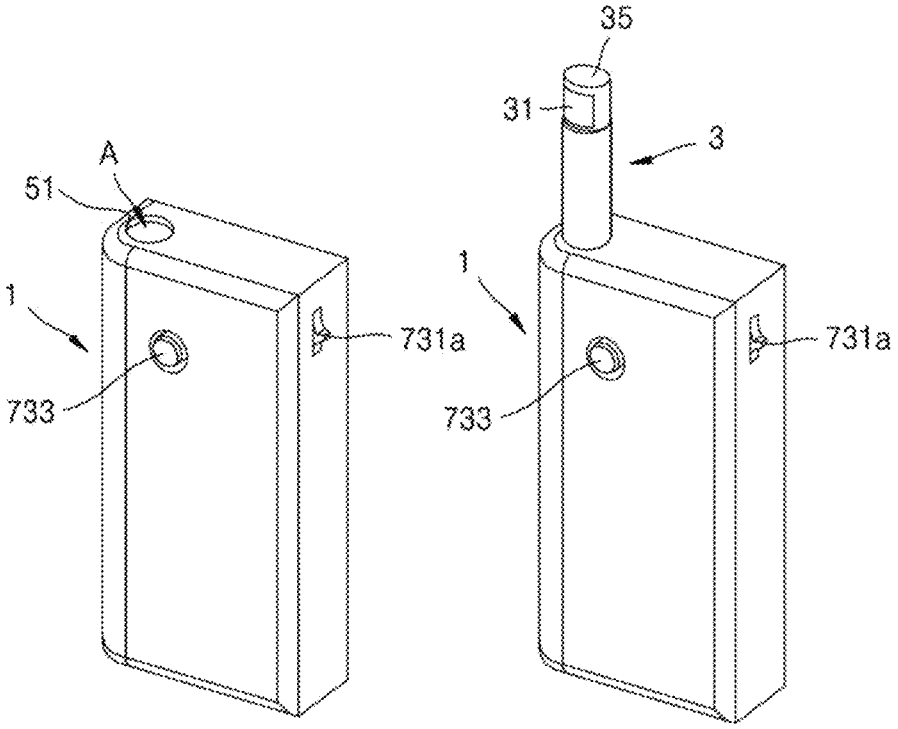
FIG. 1 is a perspective view of an aerosol generating device of the related art.

Hereinafter, preferred embodiments of the present disclosure will be described in detail with reference to the accompanying drawings. Prior to describing the present disclosure, when it is determined that a detailed description of related known functions and configurations may unnecessarily obscure the subject matter of the present disclosure, a description thereof will be omitted.

The description and drawings below illustrate specific embodiments so that those skilled in the art may readily implement the described devices and methods. Other embodiments may include structurally and logically different modifications. Individual configuration elements and functions may generally be selected unless explicitly required, and the sequence of processes may change. Parts and features of some embodiments may be included in or replaced by other embodiments.

The present disclosure provides a disposable liquid aerosol generating article 100 illustrated in FIGS. 2 to 5.

The disposable liquid aerosol generating article 100 of the present disclosure includes

- an aerosol generating substrate portion and a filter portion 20,
- wherein the aerosol generating substrate portion includes an absorber 10 impregnated with a liquid substance 12 for generating an aerosol, and
- an amount of the included liquid substance 12 corresponds to 10 to 30 times of inhalation.

The 10 to 30 times represent the number of times that may be inhaled during one smoking, and when the number of times is out of the above-described range, the amount of smoking may be insufficient or too large, resulting in wasteful use. In particular, when the inhalation amount exceeds 30 times, an impregnation amount of the liquid substance for generating an aerosol for the absorber increases, which may cause a problem that roll paper is wetted by the liquid substance.

The inhalation amount of 10 to 30 times may correspond to 10 to 60 mg of the liquid substance.

A liquid substance for generating an aerosol may be included more preferably in an inhalation amount of 10 to 20 times, and in this case, the inhalation amount of 10 to 20 times may correspond to 10 to 40 mg of the liquid substance.

In one embodiment of the present disclosure, the liquid substance for generating an aerosol may be included in an absorber in the ratio of 0.05 g to 0.8 g of the liquid substance per 1 g of the absorber. When an impregnation amount is less than 0.05 g, it is difficult to satisfy an inhalable number of times, and when the impregnation amount exceeds 0.8 g, roll paper may be wetted by a liquid substance.

In one embodiment of the present disclosure, a proportion of a liquid substance transferred from an absorber to other constituent parts of the disposable liquid aerosol generating article may be 0 to 1% by weight at a point in time when 24 hours elapse after the disposable liquid aerosol generating article is manufactured.

The proportion of a liquid substance transferred from an absorber to other constituent parts of the disposable liquid aerosol generating article is preferably closer to 0% by weight. When the proportion exceeds 1% by weight, the liquid substance may leak and quality of the disposable liquid aerosol generating article may not be maintained because the roll paper is wet. Substantially, a lower limit of the transferred proportion in the above description may be a value greater than 0.

In the above description, the proportion of a liquid substance transferred from an absorber to other constituent parts of the disposable liquid aerosol generating article means the percentage of a reduced weight of the absorber, which is a difference between the weight of the absorber measured immediately before assembling the absorber impregnated with the liquid substance into an aerosol generating article and the weight of the absorber measured again after taking the absorber out of the aerosol-generating article when 24 hours have elapsed after the aerosol generating article is assembled.

In the aerosol generating article of the present disclosure, when an aerosol generating article is manufactured by impregnating an absorber with a liquid substance in the amount of 0.05 g to 0.8 g of the liquid substance per 1 g of the absorber, the proportion of a liquid substance transferred from an absorber to other constituent parts of the disposable liquid aerosol generating article may satisfy 0 to 1% by weight, more preferably 0.1 to 0.4% by weight at a point in time when 24 hours elapse after the aerosol generating article is manufactured.

One embodiment of the present disclosure is characterized in that an absorber impregnated with an aerosol generating liquid substance is directly wrapped by roll paper for a disposable liquid aerosol generating article. This configuration is possible because leakage of the liquid substance in the absorber is adjusted to a very small range as described above.

Figure 4:
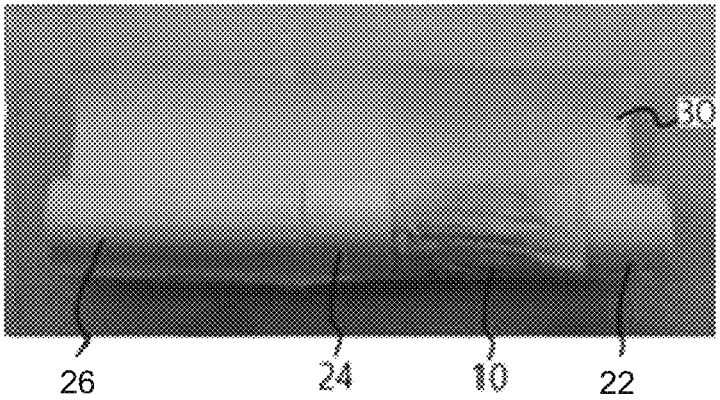
FIGS. 4 and 5 are photographs of a disposable liquid aerosol generating article according to embodiments.
Figure 5:
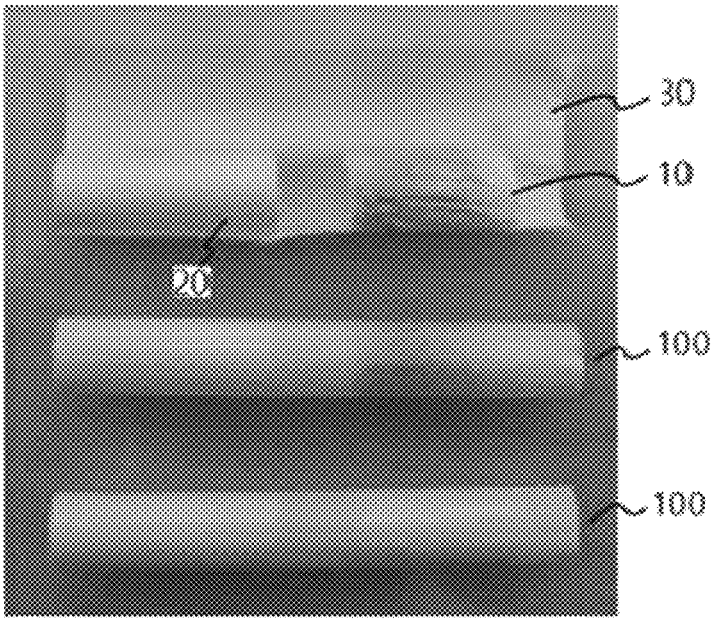

In addition, the absorber impregnated with the liquid substance may be included in a rolled form by using non-waterproof roll paper, as illustrated in FIGS. 4 and 5.

Figure 6:
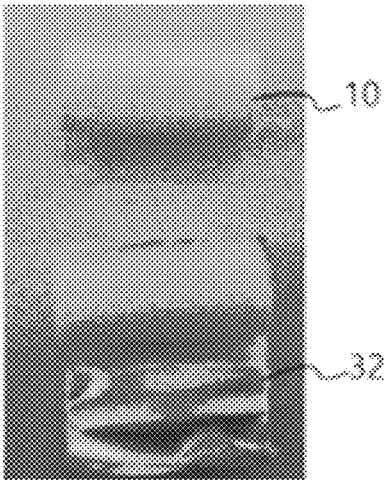
FIG. 6 is a photograph of an absorber impregnated with a liquid substance included in a disposable liquid aerosol generating article according to an embodiment.

Specifically, the absorber impregnated with the liquid substance may be wrapped first by using a waterproof skin, and then, may also be wrapped by using general roll paper that is not waterproofed, as illustrated in FIG. 6. However, this case is not preferable because a material cost and the number of processes may increase.

Therefore, the present disclosure also provides an advantage that an aerosol generating article is manufactured without waterproofing as described above.

The non-waterproof roll paper indicates roll paper used for a general dry type cigarette.

However, an embodiment may use waterproofed roll paper to implement a more stable form. Since a liquid substance rarely leaks out of an absorber, light waterproofing of an aerosol generating article may suffice.

Roll paper manufactured by the light waterproofing may include roll paper treated with a waterproofing agent during paper manufacturing, roll paper impregnated with a waterproofing agent after paper manufacturing, aluminum-coated roll paper, and so on.

In one embodiment of the present disclosure, the liquid substance may include, for example, 0.1 to 5 parts by weight of nicotine, 5 to 60 parts by weight of glycerin, and a residual amount of a solvent. However, the present disclosure is not limited thereto, and a liquid substance generally used in this field may be used.

In one embodiment of the present disclosure, the absorber impregnated with the liquid substance may be manufactured to have, for example, a length of 3 to 20 mm and a diameter of 3 to 12 mm, or manufactured to have a volume corresponding to the above dimensions.

In one embodiment of the present disclosure, the absorber may be selected from a group consisting of paper, cotton, silica, and so on but is not limited thereto, and other materials known in the art may be used as the absorber.

In one embodiment of the present disclosure, the absorber may be formed by rolling wrinkled paper.

Figure 7A:
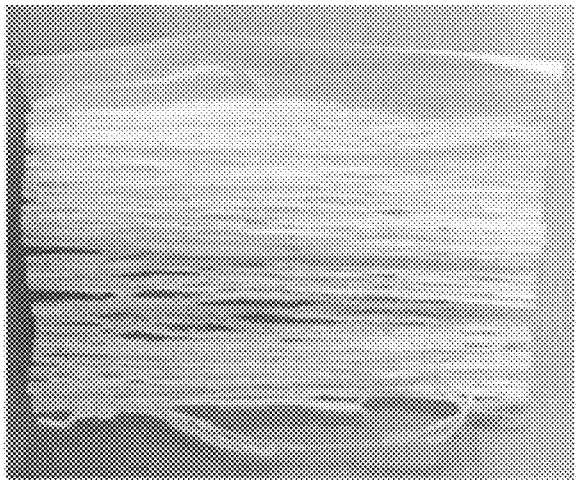
FIGS. 7A and 7B are photographs of an absorber included in a disposable liquid aerosol generating article according to embodiments.
Figure 7B:
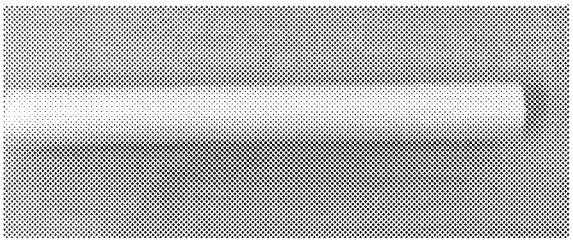

In addition, as illustrated in FIGS. 7A and 7B, the absorber may be formed by rolling crimped base paper in which stripe-shaped wrinkles or sheaths are formed. The crimping may be performed by using a crimping device, and only wrinkles may be formed or sheaths may be formed together with the wrinkles depending on a compressive strength.

In the above description, finishing may be performed with base paper that does not have wrinkles or sheaths, as illustrated in FIG. 7B.

A space between the stripe-shaped wrinkles or sheaths may be 0.1 to 10 mm, more preferably 1 to 2 mm.

In the present disclosure, the paper used as the absorber may include paper made of mulberry, bamboo, birch, and so on, and the paper made of the birch may be preferably used as the absorber.

The paper may have a thickness of 30 to 200 um, more preferably 60 to 90 um.

In the present disclosure, a method of manufacturing an absorber impregnated with a liquid substance will be described in detail as follows:

a. Preparing absorber paper (manufacturer name: Kukil Paper) made from birch;
b. Forming stripe-shaped wrinkles or sheaths in the absorber paper;
c. Spray-coating the absorber paper with glycerin;
d. Spray-coating the absorber paper coated with glycerin with nicotine;
e. Rolling and cutting the absorber paper manufactured in step d.

Figure 2:
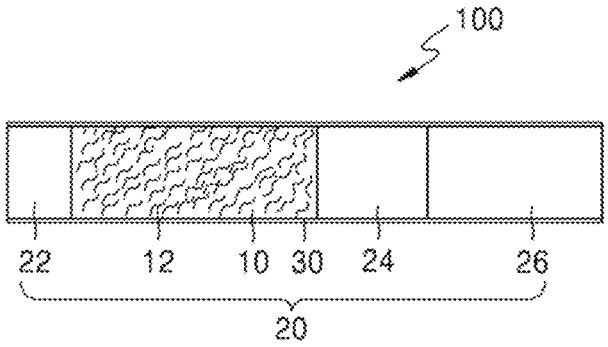
FIGS. 2 and 3 are views illustrating a disposable liquid aerosol generating article according to an embodiment.

In one embodiment of the present disclosure, a first filter portion 22 and a second filter portion 24 and 26 may be respectively provided at both ends of the aerosol generating substrate portion, as illustrated in FIGS. 2 and 4. A filter known in the art may be used for the filter portion without limitation.

For example, the second filter may include a cooling filter 24 and a mouthpiece filter 26. In addition, the second filter may further include a tube filter in front of the cooling filter 24.

The first filter may perform a function of accommodating an absorber impregnated with a liquid substance in a structurally stable manner. A filter known in the art may be used as the first filter without limitation. For example, Tube (hollow type), cellulose acetate, paper filter, recess, PLA, and so on may be used as the first filter.

As illustrated in FIG. 5, the aerosol generating article 100 may be manufactured such that an empty space is formed between the filter portion 20 and the absorber 10 impregnated with a liquid substance.

Figure 3:
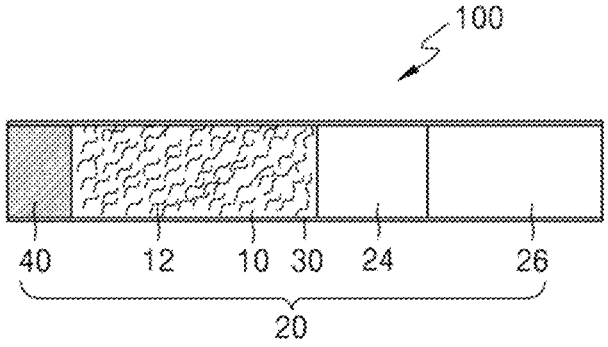

In one embodiment of the present disclosure, a combustible heat source 40 may be further provided at the tip of the aerosol generating substrate portion as illustrated in FIG. 3. When the combustible heat source 40 is further provided, the combustible heat source is directly lit during smoking, and thus, a feeling of actually smoking a cigarette may be provided.

Figure 8:
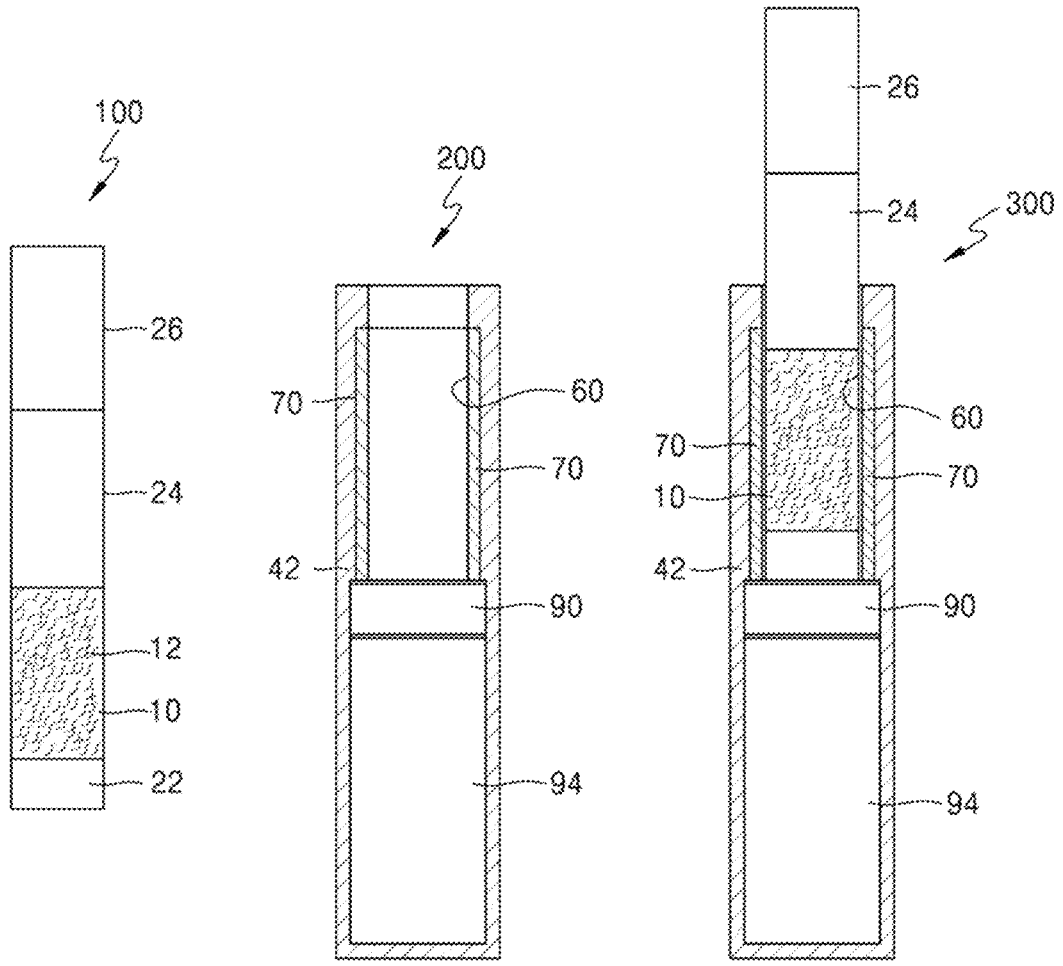
FIGS. 8 and 9 are views illustrating an aerosol generating device according to embodiments.
Figure 9:
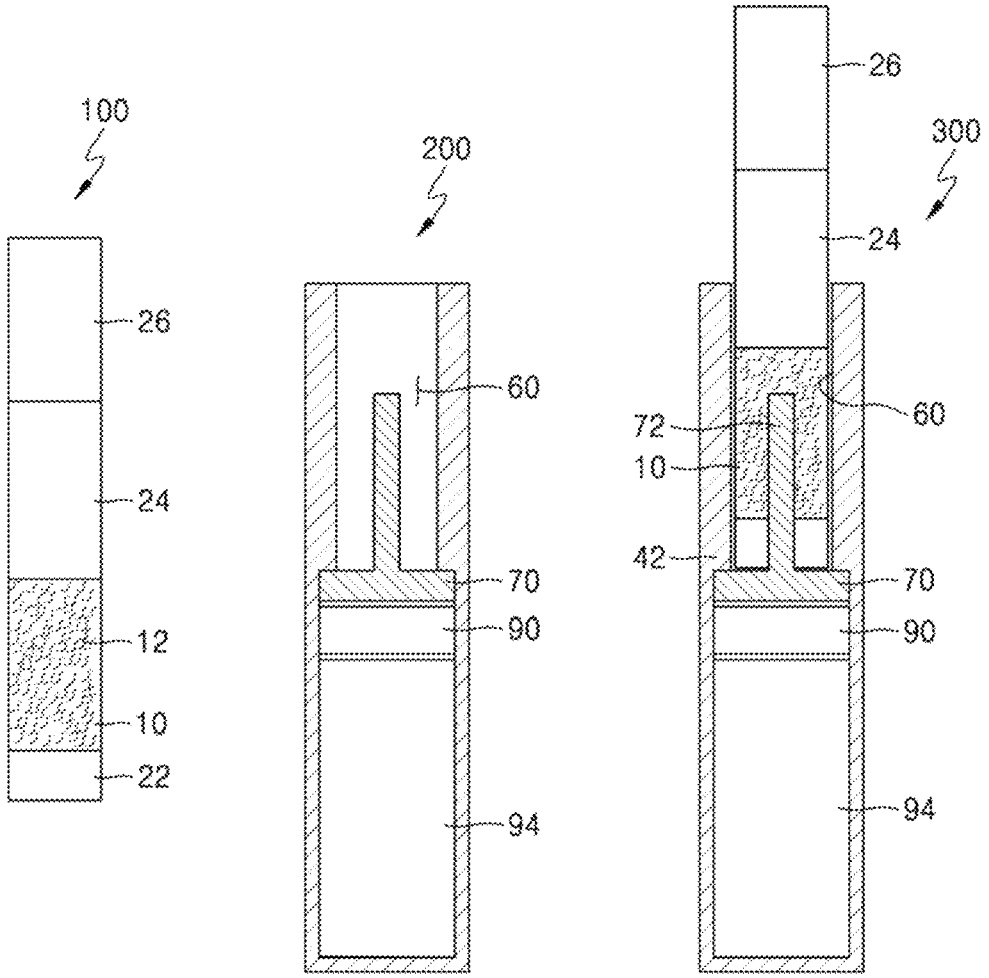

In addition, as illustrated in FIGS. 8 and 9, the present disclosure relates to an aerosol generating device 300 including the disposable liquid aerosol generating article 100 of the present disclosure and an aerosol generator 200 including an aerosol generating article accommodation groove 60 and a heater member 70 provided on the bottom of the aerosol generating article accommodation groove.

Various types of heaters known in the art may be used as the heater member 70. For example, a cylindrical heater (70 of FIG. 8), a susceptor (72 of FIG. 9) such as a blade, and so on may be used.

In the aerosol generating device 300 of the present disclosure, a technical configuration known in the art may be applied, except for the technical features specifically limited above. For example, the aerosol generator 200 may further include configurations such as the known blade type susceptor 72, a control circuit 90, and a rechargeable battery 94, as illustrated in FIG. 9.

MODE OF DISCLOSURE

Hereinafter, examples are presented to aid in the understanding of the present disclosure, but the following examples are only illustrative of the present disclosure, and it is obvious to those skilled in the art that various changes and modifications are possible within the scope and idea of the present disclosure, and it is natural that the changes and modifications fall within the scope of the appended claims.

Examples 1 to 3: Manufacturing of Aerosol Generating Articles and Measurement of Leakage The aerosol generating article of the present disclosure was manufactured in the following form illustrated in FIG. 2.

In the aerosol generating article, an absorber is manufactured by forming sheaths as illustrated in FIG. 7 by crimping paper (manufacturer name: Kukil Paper) made of birch, spraying the paper with a liquid substance for forming an aerosol, and rolling the paper.

A commercially available material including nicotine, glycerin (ELOGLYN R995, manufactured by LG Household & Health Care), propylene glycol (brand name: propylene glycol, manufactured by SKC), and so on was purchased to be used as the liquid substance.

Only a tube filter was used as a filter, and three cigarettes were manufactured by using roll paper (brand name: MFW, manufactured by Kukil Paper) that was not waterproofed.

In the above description, a weight of an absorber impregnated with a liquid substance was measured immediately before manufacturing a cigarette, and then the cigarette was manufactured. In addition, at a point in time when 24 hours elapse after the cigarette was completely manufactured, the absorber was taken out from the aerosol generating article to measure a weight again, and the weight reduced from the firstly measured weight was calculated and illustrated in following Table 1.

TABLE 1

| | Weight of absorber impregnated with liquid aerosol-generating composition before assembly of aerosol-generating article (g) (weight of impregnated liquid substance (g)) | Weight of assembled cigarette (g) | Weight of absorber impregnated with liquid aerosol-generating composition after 24 hours from completion of assembly of aerosol-generating article (g) | Change in weight of absorber impregnated with liquid aerosol-generating composition (w/w %) |
|---|---|---|---|---|
| Example 1 | 0.1080 (0.0383) | 0.401 | 0.1077 | 0.28% |
| Example 2 | 0.1117 (0.0408) | 0.4026 | 0.1113 | 0.36% |
| Example 3 | 0.1135 (0.0431) | 0.4055 | 0.1132 | 0.26% |

As illustrated in Table 1, it is confirmed that the aerosol generating article of the present disclosure has almost no leakage of a liquid substance from an absorber impregnated with a liquid substance to a cigarette outside the absorber.

Although the present disclosure is described in connection with the above-mentioned preferred embodiments, various modifications or changes may be made without departing from the idea and scope of the disclosure. Therefore, the appended claims will include the modifications or changes as long as the claims included in the gist of the present disclosure.

EXPLANATION OF REFERENCE NUMERALS

10: absorber impregnated with liquid substance 20: filter portion
22: first filter 24: cooling filter
26: mouthpiece filter 30: roll paper
32: waterproof paper 40: combustible heat source
60: aerosol generating article accommodation groove 70: heater
72: susceptor 90: control circuit
94: rechargeable battery 100: aerosol generating article
200: aerosol generator 300: aerosol generating device

What is claimed is:

1. A disposable liquid aerosol generating article comprising:
an aerosol generating substrate portion; and
a filter portion,
wherein the aerosol generating substrate portion includes an absorber impregnated with a liquid substance for forming an aerosol, and
wherein an amount of the liquid substance corresponds to 10 to 30 times of inhalation,
wherein the liquid substance for forming the aerosol is impregnated in a ratio of 0.05 g to 0.8 g of the liquid substance per 1 g of the absorber.

2. An aerosol generating device comprising:
the disposable liquid aerosol generating article of claim 1; and
an aerosol generator including an aerosol generating article accommodation groove and a heater member provided on a bottom of the aerosol generating article accommodation groove.

3. The disposable liquid aerosol generating article of claim 1, wherein a proportion of the liquid substance transferred from the absorber to other constituent parts of the disposable liquid aerosol generating article at a point in time when 24 hours elapse after the disposable liquid aerosol generating article is completely manufactured is 0 to 1% by weight.

4. The disposable liquid aerosol generating article of claim 3, wherein the absorber impregnated with the liquid substance for forming the aerosol is rolled and directly wrapped by roll paper of the disposable liquid aerosol generating article.

5. The disposable liquid aerosol generating article of claim 4, wherein the roll paper is non-waterproofed roll paper.

6. A disposable liquid aerosol generating article comprising:
an aerosol generating substrate portion; and
a filter portion,
wherein the aerosol generating substrate portion includes an absorber impregnated with a liquid substance for forming an aerosol, and
wherein an amount of the liquid substance corresponds to 10 to 30 times of inhalation,
wherein the absorber is selected from the group consisting of paper, cotton, and silica.

7. The disposable liquid aerosol generating article of claim 6, wherein the absorber is formed by rolling wrinkled paper.

8. The disposable liquid aerosol generating article of claim 7, wherein the absorber is formed by rolling base paper in which stripe-shaped wrinkles or sheaths are formed by crimping.

9. A disposable liquid aerosol generating article comprising:
an aerosol generating substrate portion; and
a filter portion,
wherein the aerosol generating substrate portion includes an absorber impregnated with a liquid substance for forming an aerosol, and
wherein an amount of the liquid substance corresponds to 10 to 30 times of inhalation,
wherein the liquid substance includes nicotine in an amount of 0.1 to 5 parts by weight, glycerin in an amount of 5 to 60 parts by weight, and a solvent in an amount of 5 to 35 parts by weight.

10. A disposable liquid aerosol generating article comprising:
an aerosol generating substrate portion; and
a filter portion,
wherein the aerosol generating substrate portion includes an absorber impregnated with a liquid substance for forming an aerosol,
wherein an amount of the liquid substance corresponds to 10 to 30 times of inhalation, and wherein the filter portion includes a first filter portion and a second filter portion respectively provided at both ends of the aerosol generating substrate portion.

* * * * *